US006852961B2

(12) United States Patent
Kawai

(10) Patent No.: US 6,852,961 B2
(45) Date of Patent: Feb. 8, 2005

(54) HIGH FREQUENCY HEATING APPARATUS PROVIDED WITH A SWITCH ATTACHMENT MECHANSM CAPABLE OF COVERING AT LEAST ONE SWITCH FROM OUTSIDE

(75) Inventor: Kazuhiro Kawai, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/738,042

(22) Filed: Dec. 18, 2003

(65) Prior Publication Data

US 2004/0144778 A1 Jul. 29, 2004

(30) Foreign Application Priority Data

Dec. 20, 2002 (JP) ..... 2002-370365

(51) Int. Cl.[7] ..... H05B 6/68

(52) U.S. Cl. ..... 219/722; 219/724; 126/197; 200/50.01

(58) Field of Search ..... 219/722, 723, 219/724, 756, 739; 126/197, 192; 200/50.01–50.04, 50.12, 50.18

(56) References Cited

U.S. PATENT DOCUMENTS 4,745,250 A * 5/1988 Mayo ..... 219/722
4,764,648 A * 8/1988 Resh ..... 200/50.1
6,043,473 A * 3/2000 Isogai et al. ..... 219/722

FOREIGN PATENT DOCUMENTS

JP 2000-156283 6/2000
JP 2001-319769 11/2001

* cited by examiner

*Primary Examiner*—Philip H. Leung
(74) *Attorney, Agent, or Firm*—Bacon & Thomas, PLLC

(57) ABSTRACT

A high frequency heating apparatus includes a switch attachment member for mounting switches, a switch operating member rotatably installed at the switch attachment member and a stopper for regulating the rotation of the switch operating member. The switch attachment member has a hole for accommodating therein a hook of a door key and a portion thereof functions to cover at least one switch.

9 Claims, 13 Drawing Sheets

HIGH FREQUENCY HEATING APPARATUS PROVIDED WITH A SWITCH ATTACHMENT MECHANSM CAPABLE OF COVERING AT LEAST ONE SWITCH FROM OUTSIDE

FIELD OF THE INVENTION

The present invention relates to a high frequency heating apparatus; and more particularly, to an attachment structure and an operational mechanism of switches being operated in response to closing and opening of a door thereof.

BACKGROUND OF THE INVENTION

In general, a high frequency heating apparatus such as a microwave oven is provided with a switch attachment mechanism having a plurality of safety switches for stopping to generate a high frequency wave when a door of a heating chamber is opened. An attachment structure and an operational mechanism of the switch become complicated to provide a shielding protecting it from foreign subjects, e.g., dust and the like, and a safety mechanism securing a reliable operation of the apparatus by preventing a malfunction caused by a user's mistake.

Referring to FIG. 11, there is shown a first prior art switch attachment mechanism disclosed in Japanese Patent Laid-Open Publication No. 2000-156283. As shown, the first prior art switch attachment mechanism includes three switches 23, 24, 25; upper and lower hooks 27A, 27B; and three switch operating members 26A, 26B, 26C. Switches 23, 24, 25 are operated by respective corresponding switch operating members 26A, 26B, 26C rotated by hooks 27A, 27B. The structure of the first prior art switch attachment mechanism is rather complex and it takes time and skill to assemble components used therein since each component should be produced very accurately in dimension.

Referring to FIG. 12, there is shown a second prior art switch attachment mechanism disclosed in Japanese Patent Laid-Open Publication No. 2001-319769. In such a switch attachment mechanism, since two switches 23 and 24 are directly operated by upper and lower hooks 27A and 27B of door key 27 formed as a single body, it needs only one switch operating member 26 to operate switch 25. Accordingly, its structure is simpler than that of the first one. However, to ensure a reliable operation of the switch, switch operating member 26 of the second prior art switch attachment mechanism becomes complicated in structure and should be produced very accurately in dimension as well.

In order to overcome the above-mentioned problems, some of high frequency heating apparatus has recently employed a third switch attachment mechanism as shown in FIG. 13. In such a third switch attachment mechanism, since all of switches 23, 24, 25 are directly operated by hooks 27A and 27B of door key 27 as shown in FIG. 12, its structure can be further simplified.

In case of the prior art switch attachment mechanisms where the switches are operated by the hooks of the door key through at least one switch operating member, these switch attachment mechanisms become structurally complicated and it will take time and skill to assemble them since it should be manufactured very precisely in dimension.

In case of the prior art switch attachment mechanism where the switches are directly operated by the hooks of the door key, space around an actuator of the switch is exposed through a hole accommodating the lower hook. Accordingly, if a child's finger or foreign substances are inserted through the hole, it may cause a malfunction or a failure of the switch.

SUMMARY OF THE INVENTION

It is, therefore, an object of the present invention to provide a switch attachment mechanism for use in a high frequency heating apparatus, the switch attachment mechanism being capable of reducing the number of assembling process and the cost therefor while maintaining operational reliability and safety of a switch mounted therein. This is achieved by combination of a switch attachment member and a switch operating member having a simple structure and a stopper for regulating the rotation of the switch operating member.

In accordance with a preferred embodiment of the present invention, there is provided a high frequency heating apparatus, including: a heating chamber having an opening, for loading therein an object to be heated; a door engaged to the heating chamber, for opening and closing the opening of the heating chamber; a door key slidably or rotatably installed at the door, the door key including at least one hook and being biased to a predetermined direction within its operation region; a plurality of switches operated by said at least one hook of the door key in response to opening and closing of the door; a switch attachment member for fixedly mounting the switches, the switch attachment member including at least one hole in which said at least one hook is latched when the door is closed; and a switch operating member rotatably installed at the switch attachment member, wherein a portion of the switch operating member is located close to the hole to COVER at least one switch from outside.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF PREFERRED EMBODIMENTS

Preferred embodiments of the present invention will now be described in detail with reference to the accompanying drawings.

[Embodiment 1]

FIGS. 1 to 6 are a front view of a high frequency heating apparatus in accordance with a first preferred embodiment of the present invention, a side view of a switch attachment mechanism thereof, a front view of the switch attachment mechanism, an external appearance of a door key to be installed at a door of a heating chamber thereof, a side view of a door release lever for opening the door and a side view for setting forth an engagement of the switch attachment mechanism with hooks of the door key installed at the door when the door is closed, respectively.

Figure 1:
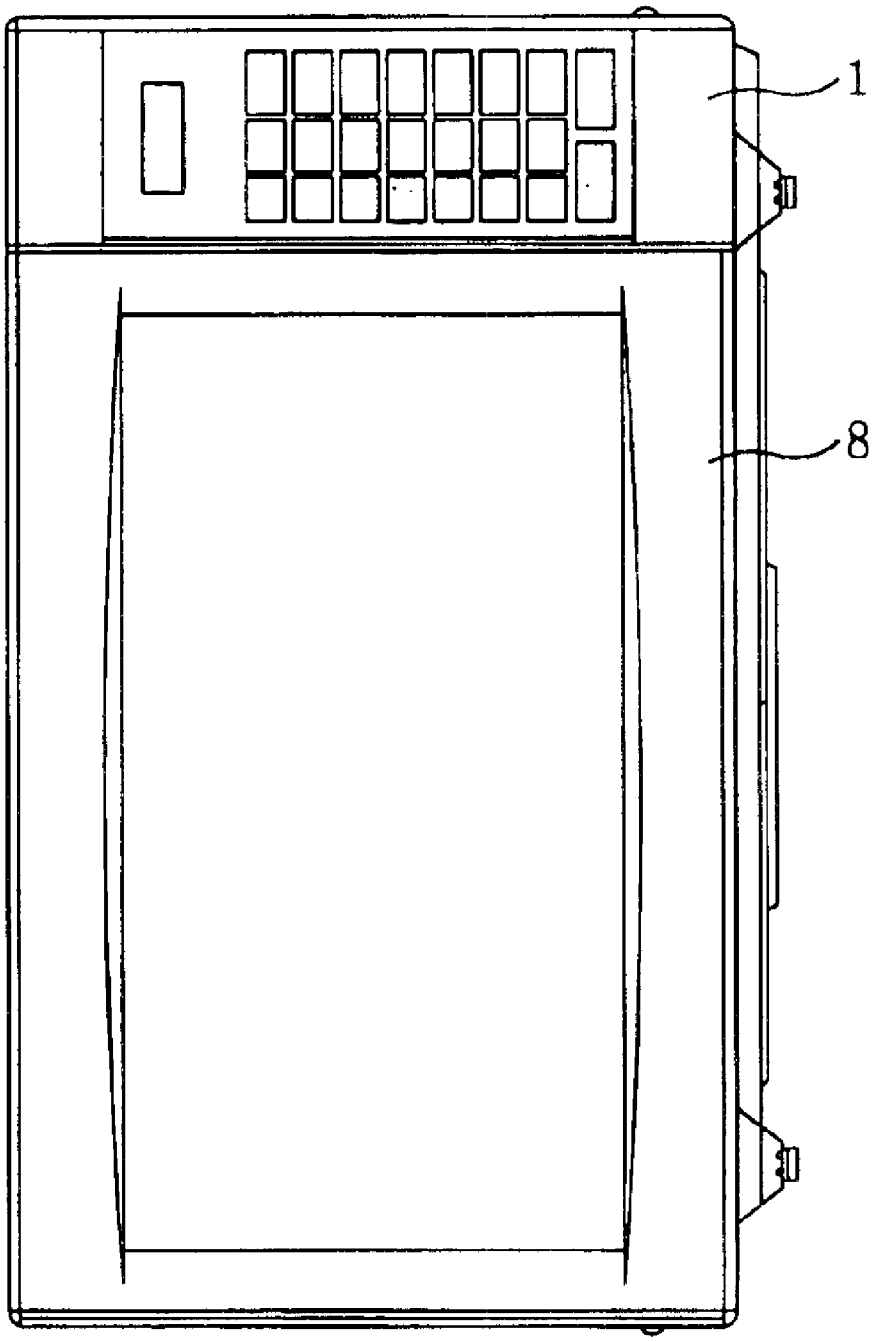
FIG. 1 is a front view of a high frequency heating apparatus in accordance with a first preferred embodiment of the present invention.
Figure 2:
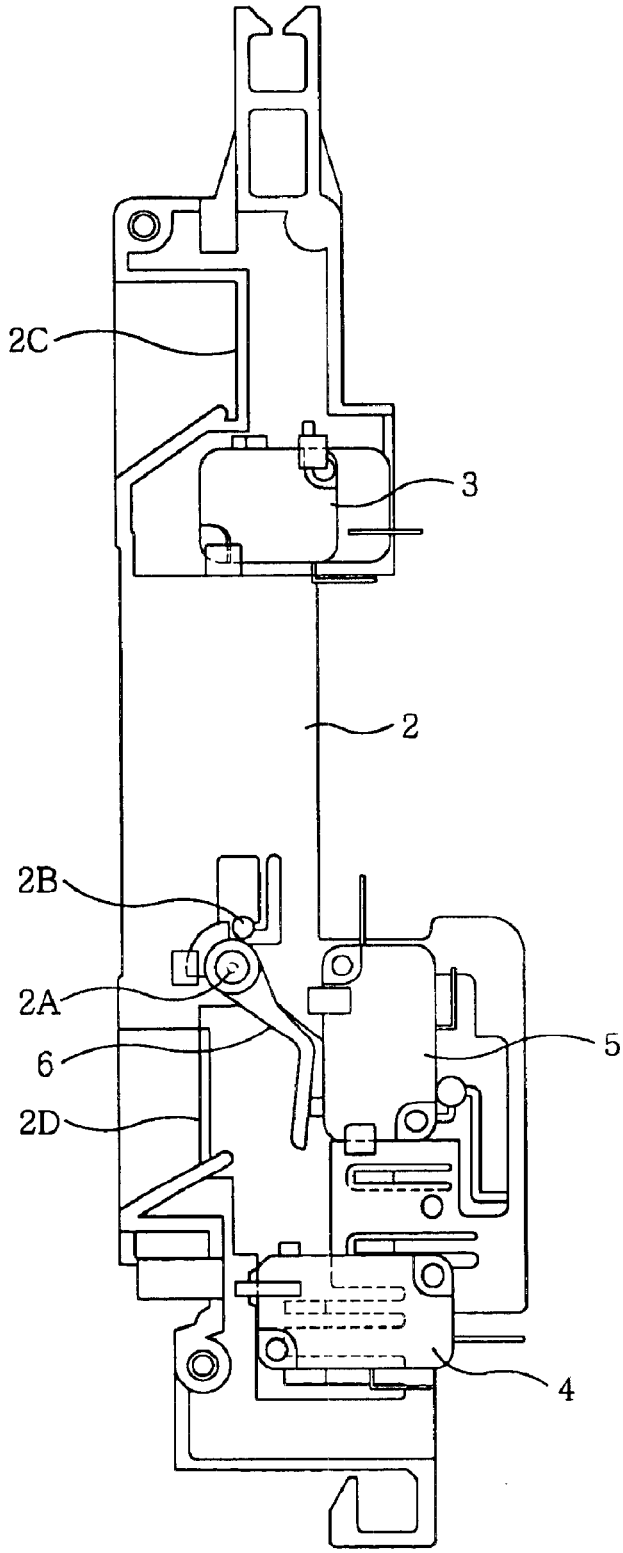
FIG. 2 provides a side view of a switch attachment mechanism of the high frequency heating apparatus shown in FIG. 1.

Referring to FIG. 1, at an upper right portion of the high frequency heating apparatus is installed door release button 1 which is pushed when door 8 is opened. As shown in FIG. 2, switch attachment member 2 includes protrusions, recesses or the like for fixedly positioning a plurality of switches, e.g., first to third switches 3, 4, 5.

Figure 3:
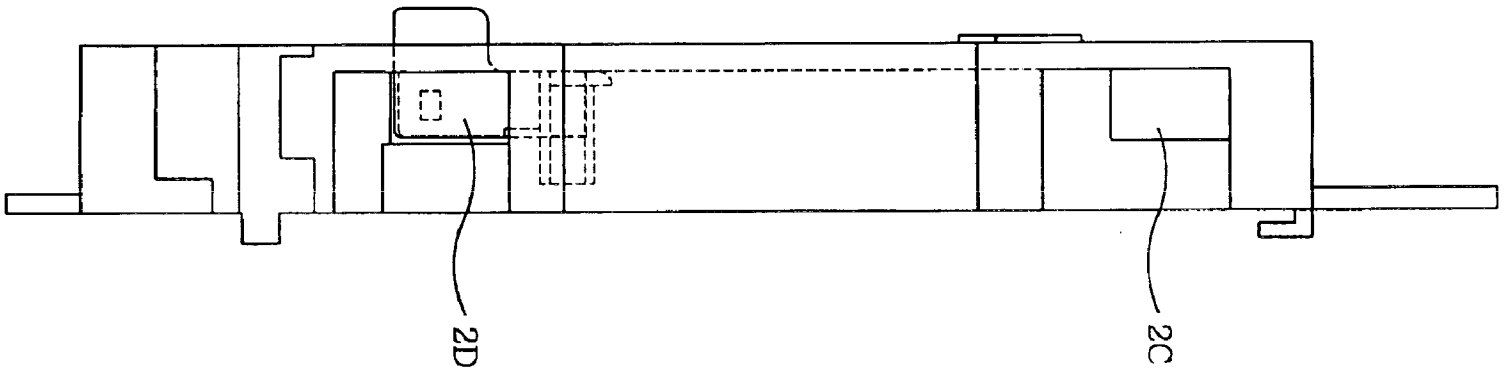
FIG. 3 illustrates a front view of the switch attachment mechanism shown in FIG. 2.

At a front region of third switch 5 is installed switch operating member 6 biased toward hole 2D to be rotatable about shaft 2A formed at switch attachment member 2, wherein a portion of switch operating member 6 is positioned between third switch 5 and hole 2D. Switch attachment member 2 is provided with stopper 2B for regulating the rotation of switch operating member 6. Furthermore, switch attachment member 2 has a pair of holes 2C and 2D as shown in FIG. 3 in which upper and lower hooks 7A and 7B of door key 7 shown in FIG. 4 are respectively accommodated to be latched (see FIG. 6) when door 8 of a heating chamber (not shown) is closed, thereby keeping door 8 closed.

First and second switches 3 and 4 function to stop generation of high-frequency waves by selectively opening a high-frequency oscillatory circuit. Third switch 5 monitors activation of at least one of first and second switches 3 and 4 and if either one of first and second switches 3 and 4 is out of order, it stops generation of high-frequency waves by opening a high-frequency oscillatory circuit.

Figure 4:
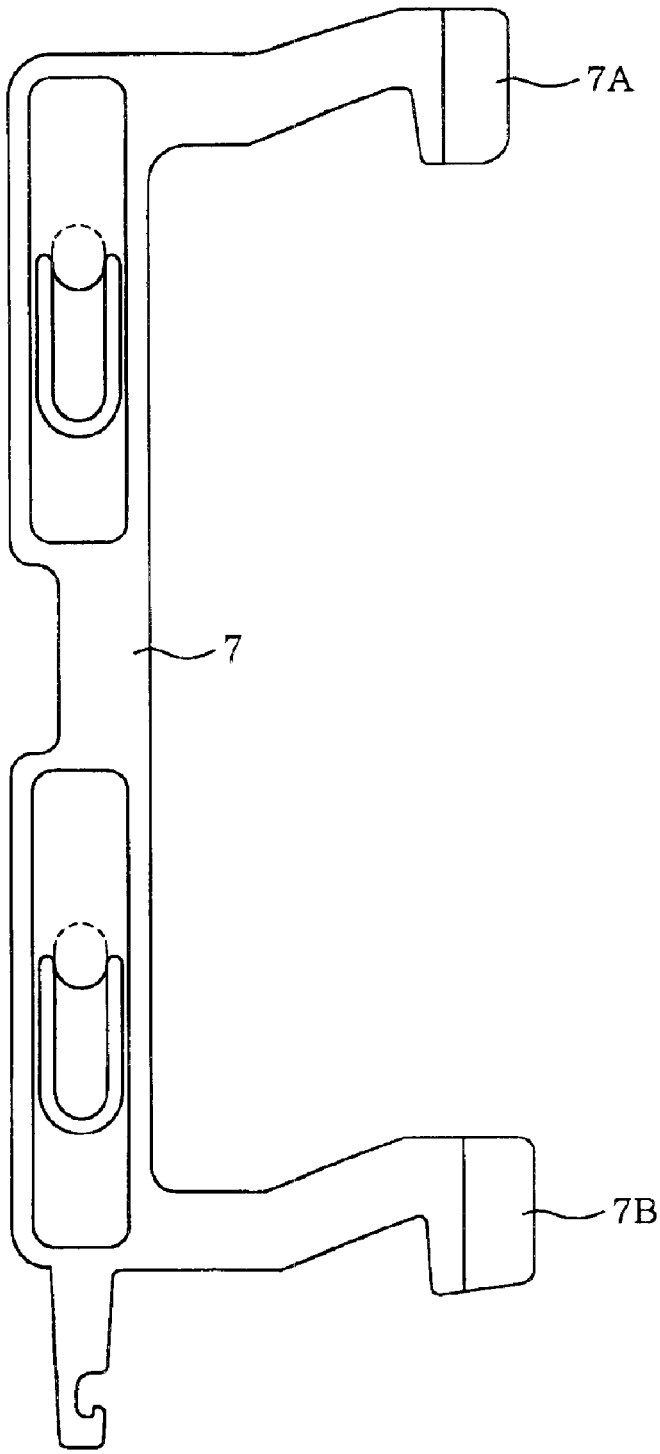
FIG. 4 depicts an external appearance of a door key to be installed at a door of a heating chamber of the high frequency heating apparatus shown in FIG. 1.
Figure 6:
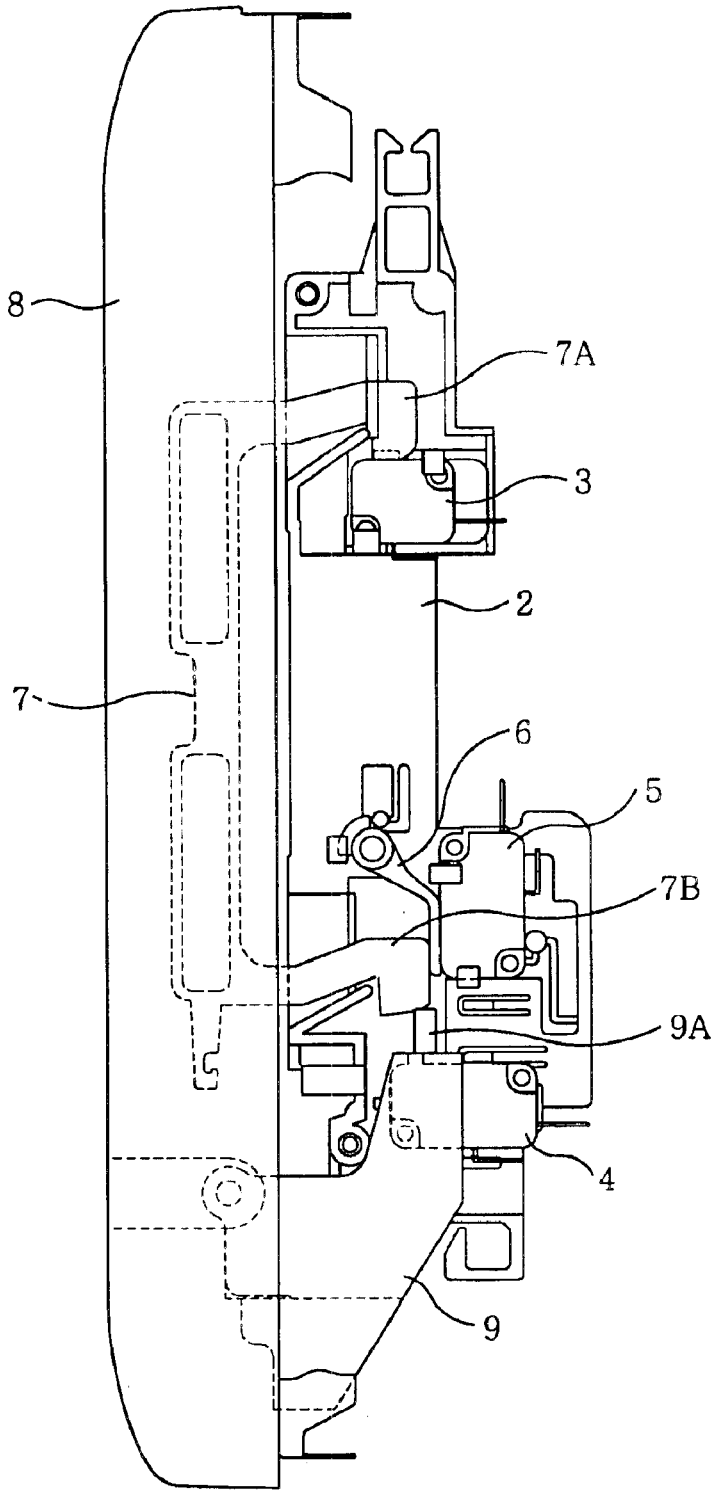
FIG. 6 presents a side view for setting forth an engagement of the switch attachment mechanism shown in FIG. 2 with hooks of the door key installed at the door shown in FIG. 1 when the door is closed.

As shown in FIGS. 4 and 6, door key 7 is slidably or rotatably installed at door 8 and is biased to a predetermined direction, e.g., downward direction as viewed from FIG. 6, within its operation range by a resilient member such as a spring. When door 8 is closed, third switch 5 is pushed by lower hook 7B to make it open at its contact point. Thereafter, first switch 3 is pushed by upper hook 7A and second switch 4 is pressed downward by lower hook 7B via door release lever 9 to make both switches closed at their respective contact points to start generating high frequency waves, so that an object accommodated in the heating chamber to be heated can be heated by high frequency waves generated.

Figure 5:
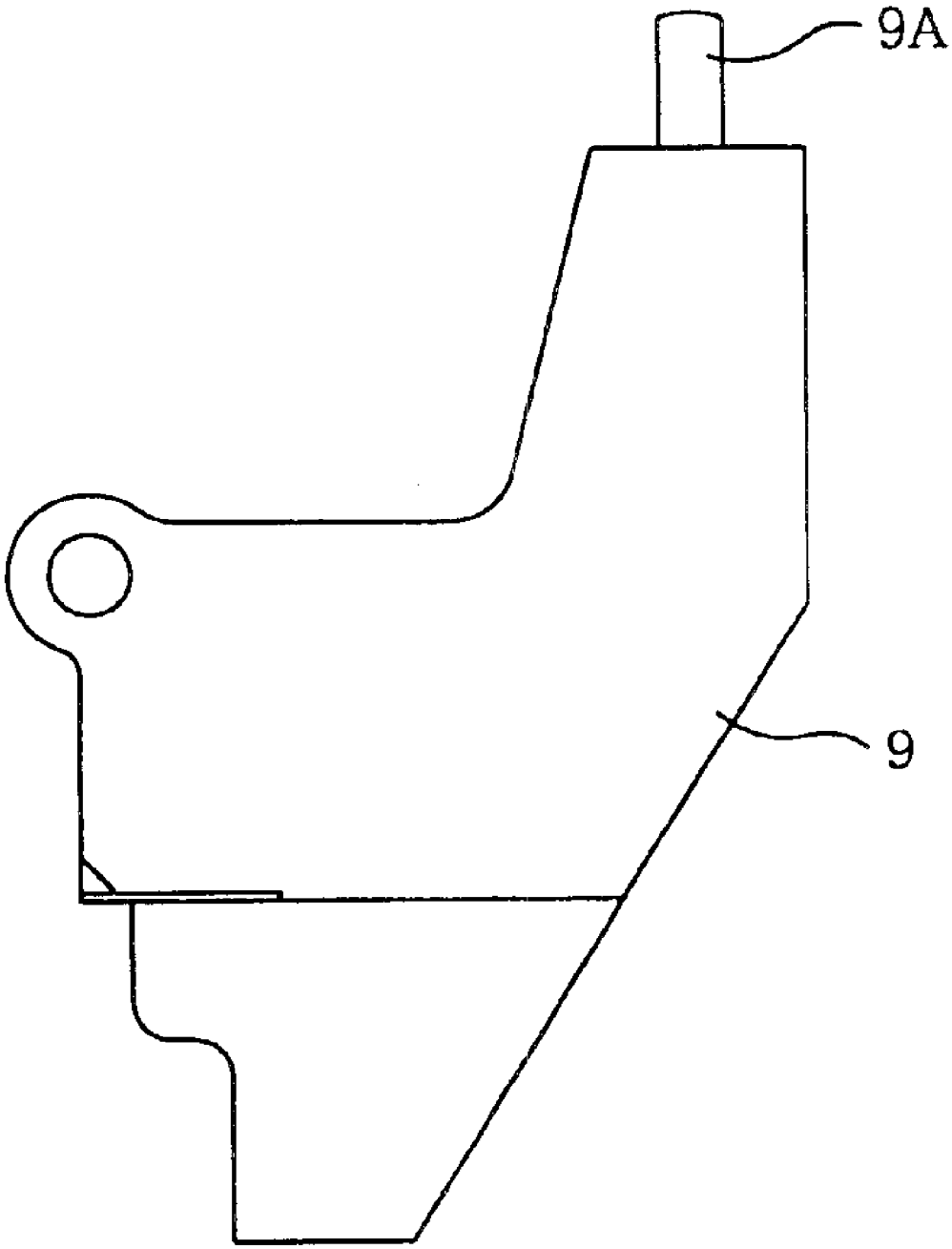
FIG. 5 shows a side view of a door release lever for opening the door shown in FIG. 1.

As shown in FIGS. 5 and 6, door release lever 9 for opening door 8 is shaft-supported at a vicinity of an opening of the heating chamber. When door release lever 9 is pushed by door release button 1, its free end 9A presses lower hook 7B upward such that the interlock of door key 7 and switch attachment member 2 are released from each other, thereby opening door 8. At this time, contact points of first and second switches 3 and 4 are opened so that the high-frequency oscillatory circuit is opened even while heating process is carried out. Subsequently, contact point of third switch 5 is closed and monitors whether or not at least one of first and second switches 3 and 4 or both are out of order. If either one of first and second switches 3 and 4 is out of order, third switch 5 stops the operation of the high-frequency oscillatory circuit to ensure the safety of a user.

As described above, since the rotation of switch operating member 6 is regulated by stopper 2B provided at switch attachment member 2, switch operating member 6 can cover third switch 5 such that it will not be exposed through hole 2D. Therefore, it can prevent insertion of a child's finger or foreign substances therethrough.

In the above description, stopper 2B is assumed to be installed at switch attachment member 2 as a separate part, it can be formed as a single body therewith. This will decrease the number of components required to facilitate the assembly process. Furthermore, stopper 2B may be a resilient member pressing switch operating member 6 in a counterclockwise direction as viewed of FIG. 2 to prevent switch operating member 6 from moving away from third switch 5 more than a predetermined distance. The resilient member may be a separate part from switch attachment member 2 or be formed as a single body therewith.

In such a structure, when door release lever 9 is pressed by door release button 1 in order to open door 8, its free end 9A is rotated upward. At this time, if switch operating member 6 is moved toward hole 2D, the upward motion of free end 9A may be hindered thereby. In this case, since free end 9A cannot pivot lower hook 7B upward, it is possible that door 8 may not be opened. For this reason, free end 9A is so configured that it does not make a contact with door operating member 6 even if free end 9A rises up to its maximum upward movable distance. With this structure, door release lever 9 can pivot without being hindered by switch operating member 6 moving toward hole 2D and therefore door 8 can be opened without any problem.

[Embodiment 2]

FIGS. 7 to 10 represent a front view of a high frequency heating apparatus in accordance with a second preferred embodiment of the present invention, a side view of a switch attachment mechanism thereof, an external appearance of door key thereof and a side view for setting forth an engagement of switch attachment mechanism with hooks and of door key installed at door when door is closed. Further, elements similar or identical to those of the first embodiment will be represented by like reference numerals and the detail description thereof will be omitted.

Figure 7:
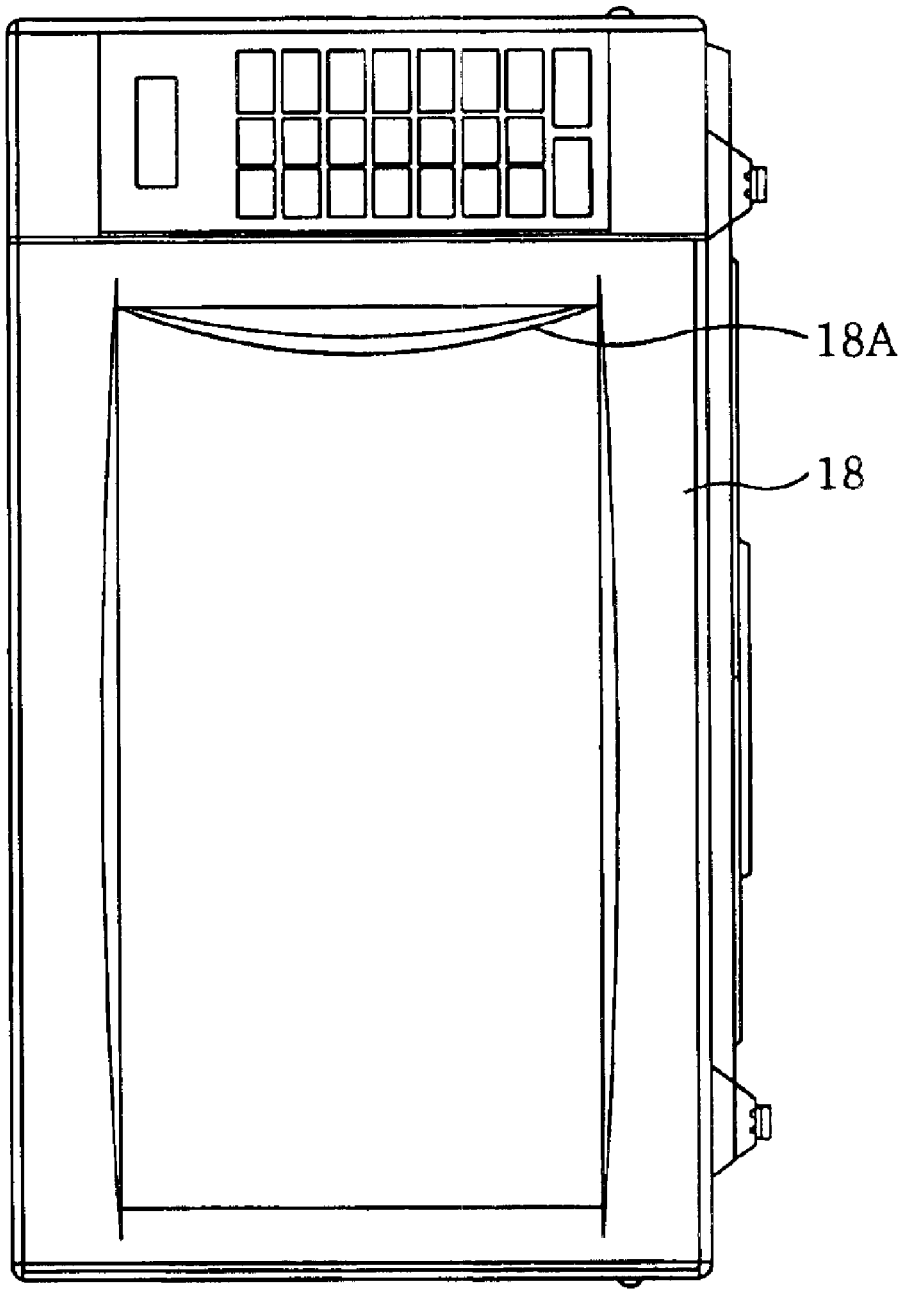
FIG. 7 represents a front view of a high frequency heating apparatus in accordance with a second preferred embodiment of the present invention.
Figure 9:
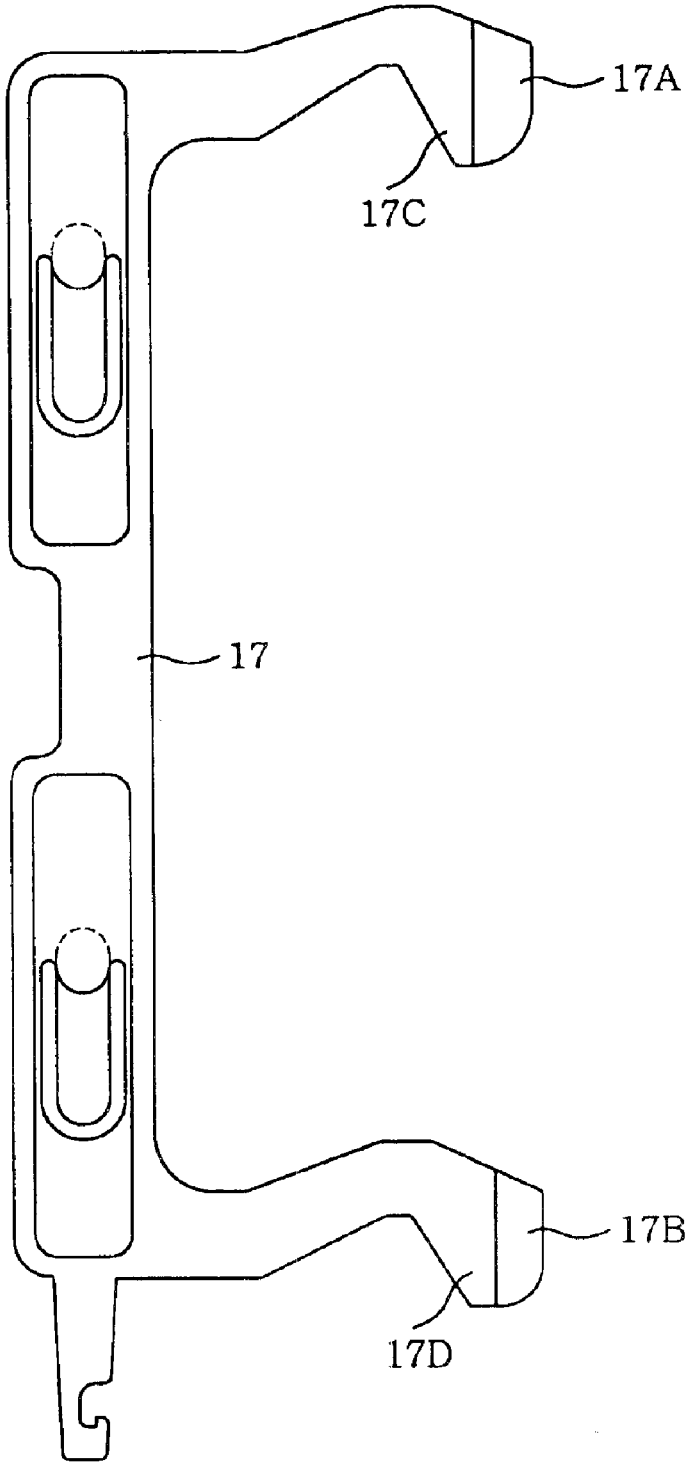
FIG. 9 describes an external appearance of a door key to be installed at a door of a heating chamber of the high frequency heating apparatus shown in FIG. 7.

Since the high frequency heating apparatus shown in FIG. 7 is not provided with a door release button, door 18 is opened and closed by a user pulling its handle 18A. In such a high frequency heating apparatus, since when door 18 is pulled in an opening direction, latch of door key 17 and switch attachment member 2 are easily released, upper and lower hooks 17A and 17B are respectively provided with slide portions 17C and 17D as shown in FIG. 9. When handle 18A is pulled, upward force is exerted on upper and lower hooks 17A and 17B. When the upward force becomes greater than a bias force of door key 17, door key 17 is slidably moved upward due to the release of slide portions 17C and 17D from holes 2C and 2D, respectively, resulting in door 18 being opened.

Figure 8:
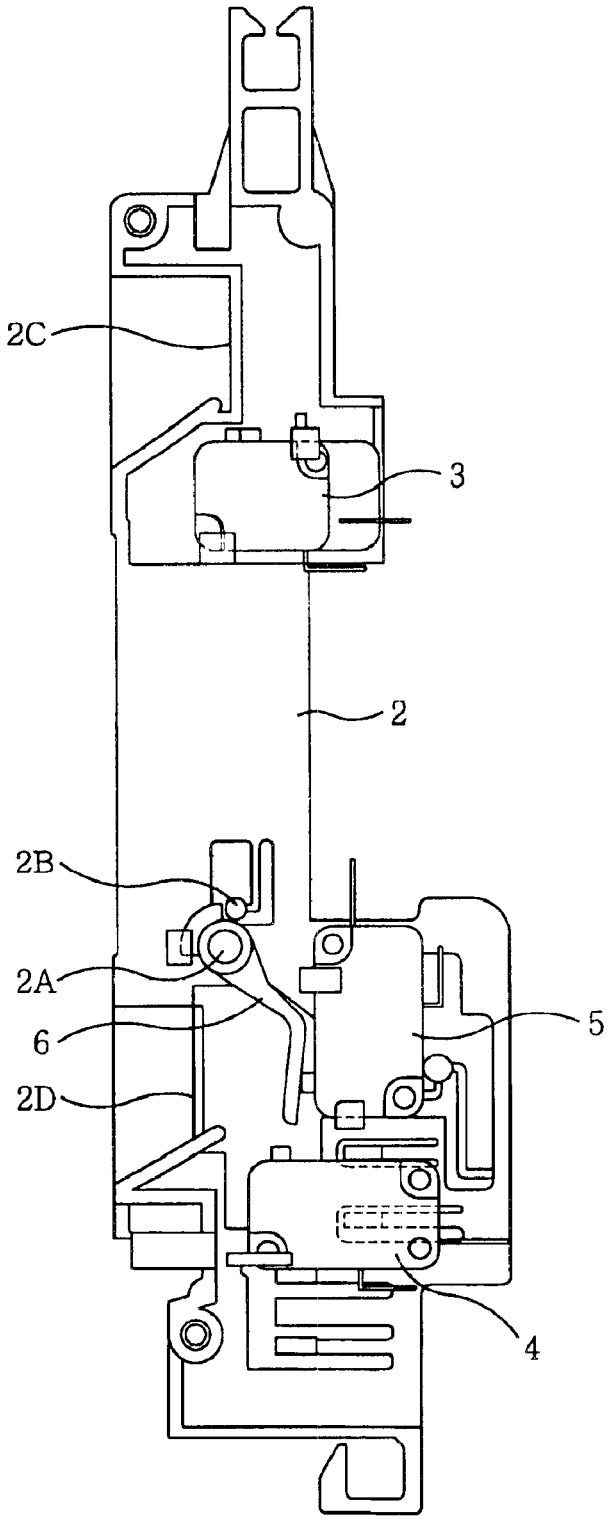
FIG. 8 discloses a side view of a switch attachment mechanism of the high frequency heating apparatus shown in FIG. 7.
Figure 10:
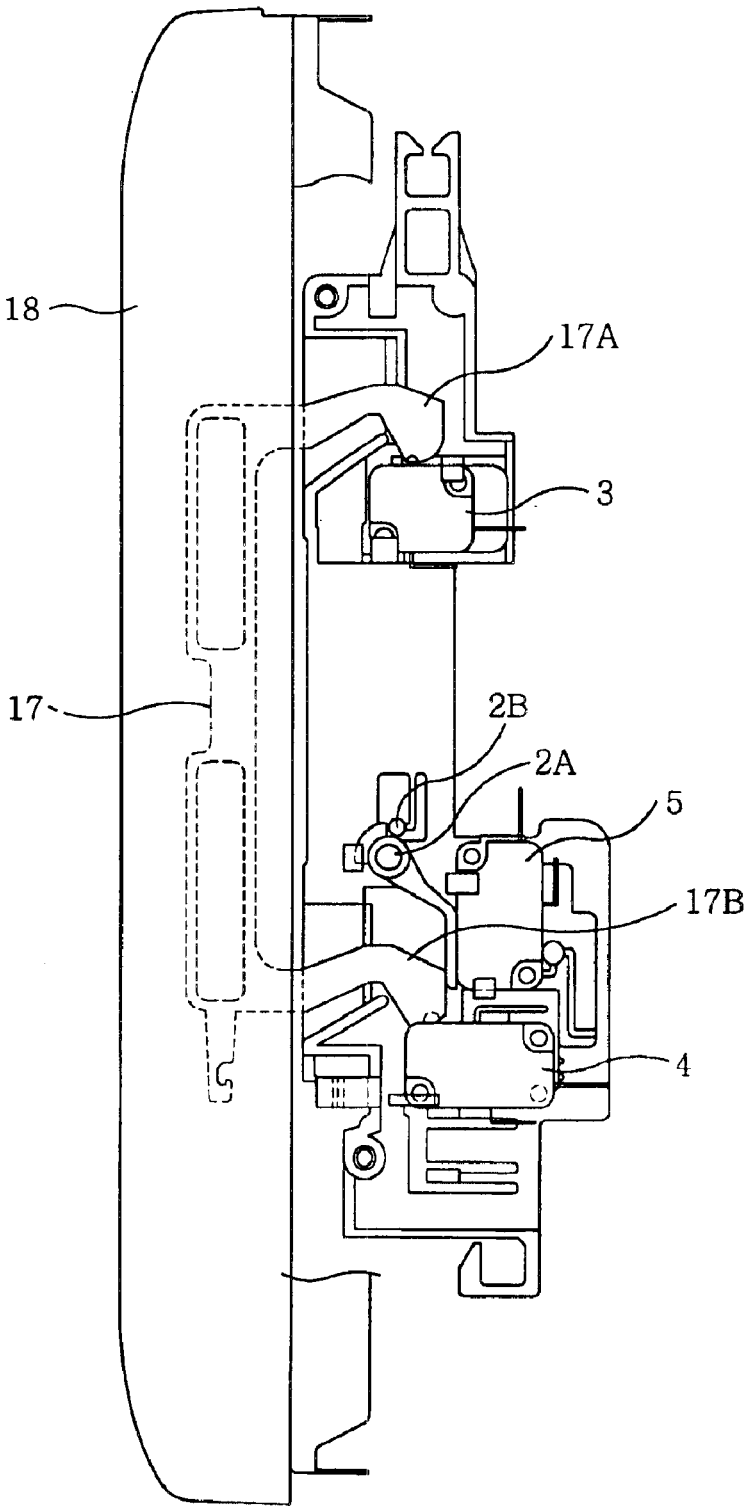
FIG. 10 offers a side view for setting forth an engagement of the switch attachment mechanism shown in FIG. 8 with hooks of a door key installed at the door shown in FIG. 7 when the door is closed.
Figure 11:
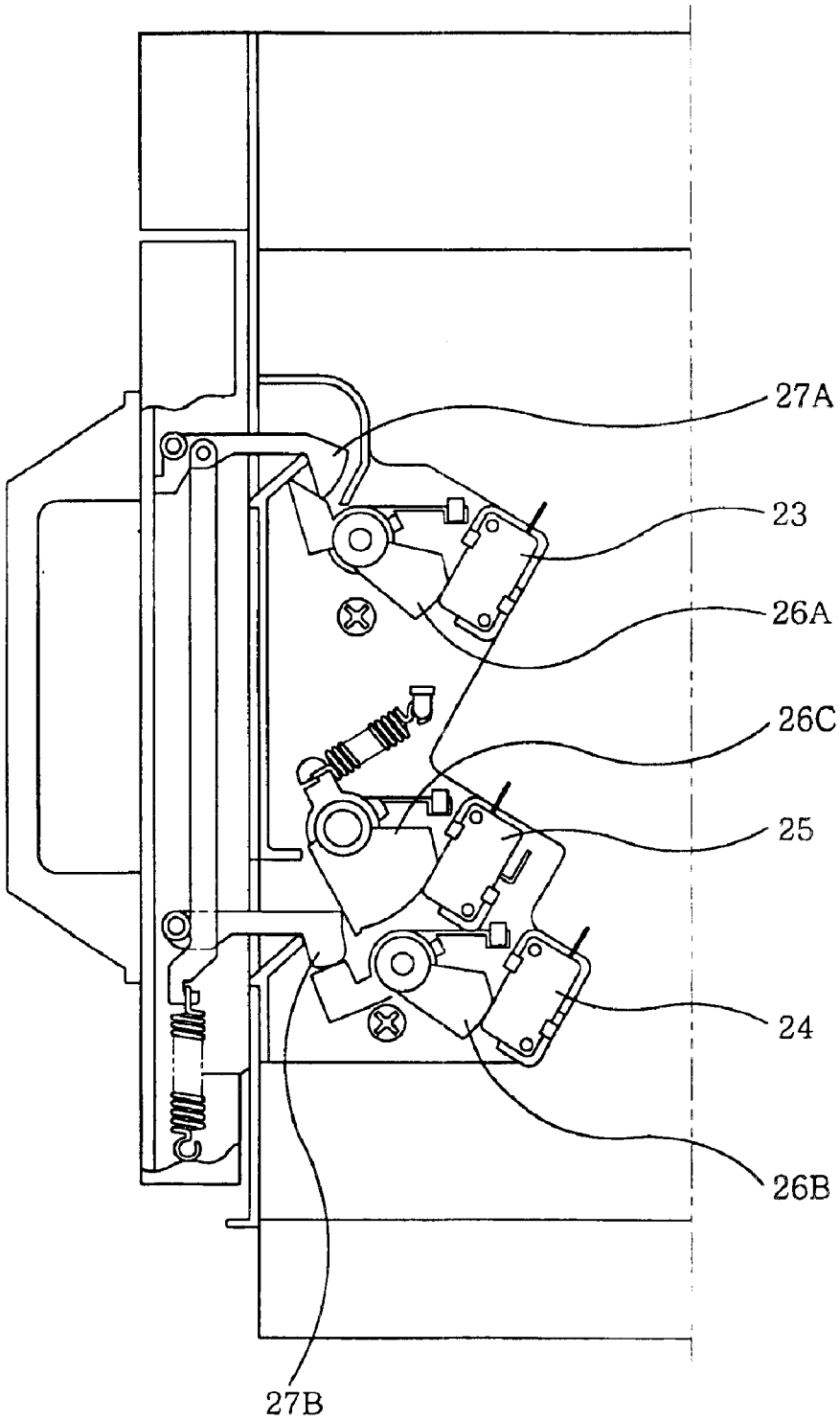
FIG. 11 (PRIOR ART)
FIG. 11 delineates a side view of a switch attachment mechanism of a first prior art high frequency heating apparatus.
Figure 12:
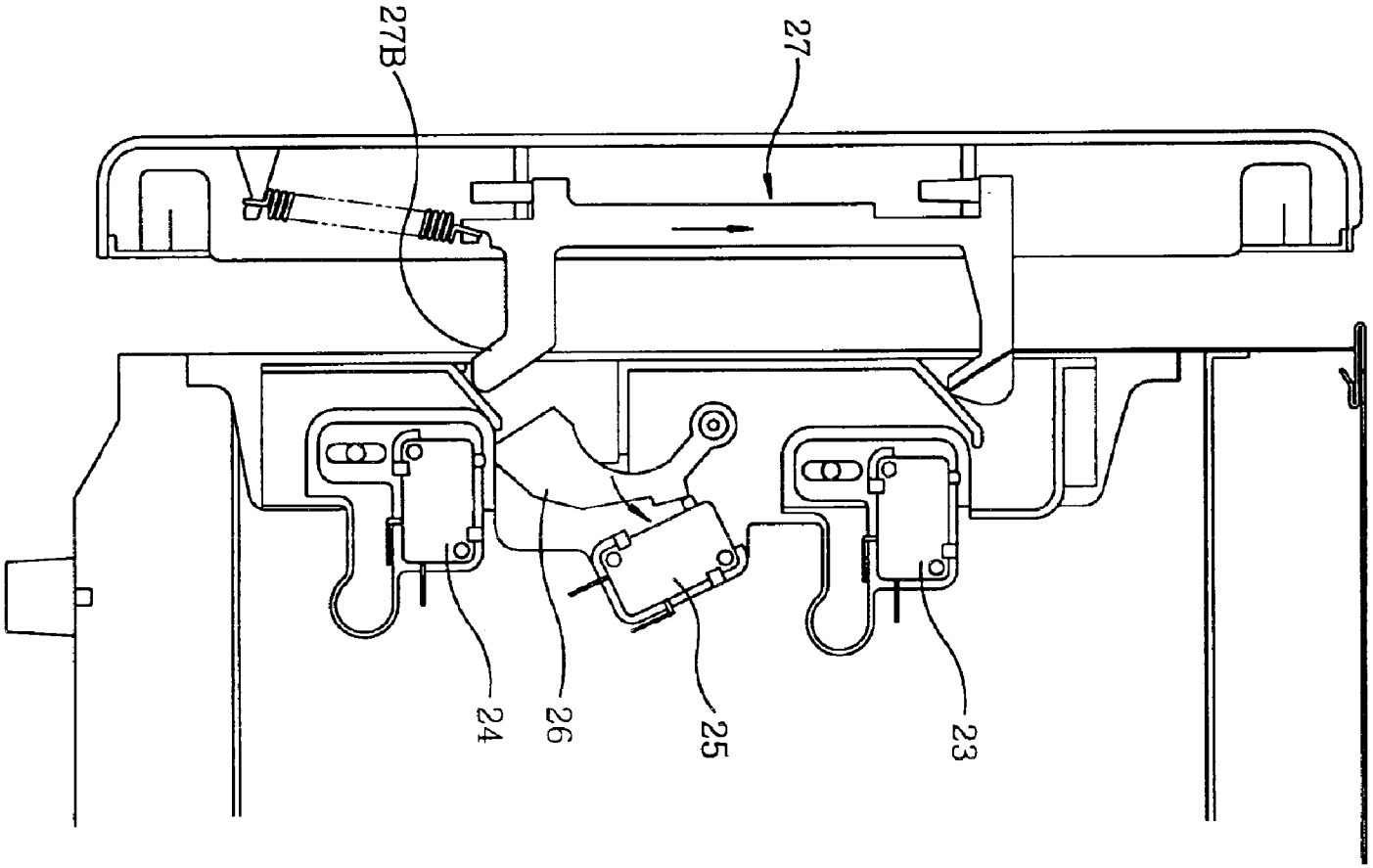
FIG. 12 (PRIOR ART)
FIG. 12 gives a side view of a switch attachment mechanism of a second prior art high frequency heating apparatus.
Figure 13:
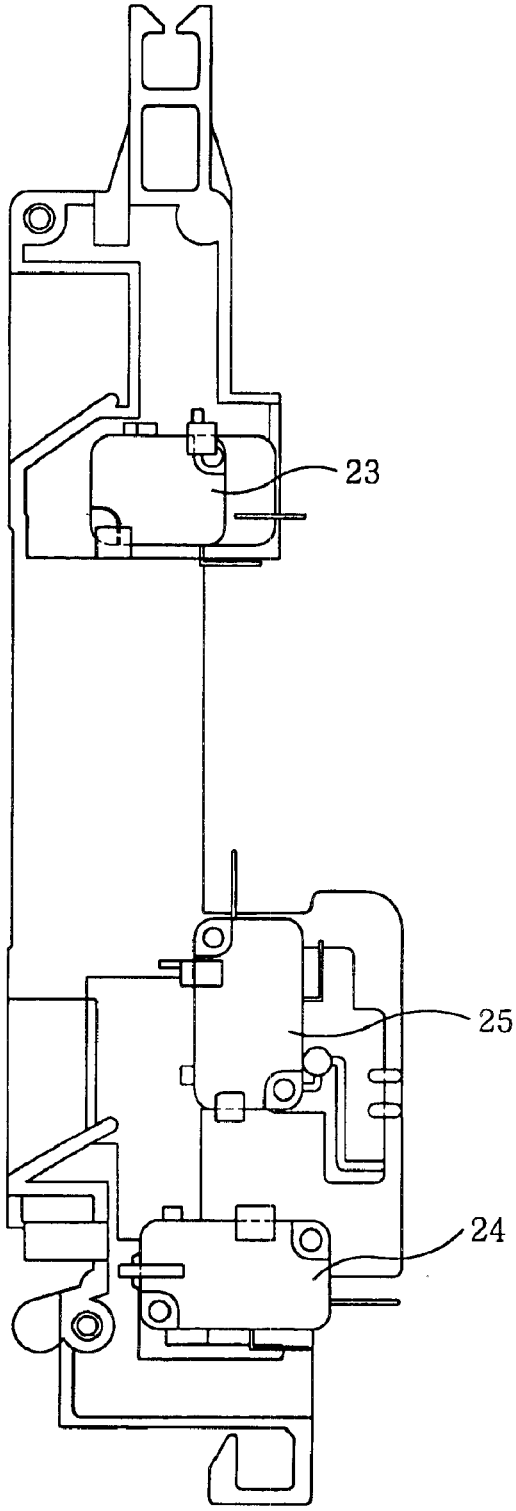
FIG. 13 (PRIOR ART)
FIG. 13 demonstrates a side view of a switch attachment mechanism of a third prior art high frequency heating apparatus.

Switch attachment member 2 in accordance with the second preferred embodiment includes two or more mounting bases for mounting second switch 4, each mounting base being provided with protrusions, recesses or the like for fixedly positioning second switch 4. This allows second switch 4 to be selectively mounted suitably for the occasion. Since the high frequency heating apparatus in accordance with the second preferred embodiment does not require door release lever 9 as described in the first one, second switch 4 in accordance with the second preferred embodiment can be mounted at a location higher than that in the first one as shown in FIGS. 8 and 10. Accordingly, second switch 4 is directly opened and closed by lower hook 17B. By being provided with two or more mounting bases, switch attachment member 2 is applicable to two type high frequency heating apparatuses having a different configuration to each other. Therefore, it is possible to simplify a supply and production of components and to reduce the production cost therefor.

While the invention has been shown and described with respect to the preferred embodiments, it will be understood by those skilled in the art that various changes and modifications may be made without departing from the spirit and scope of the invention as defined in the following claims.

What is claimed is:

1. A high frequency heating apparatus, comprising:

a heating chamber having an opening, for loading therein an object to be heated;

a door coupled to the heating chamber, for opening and closing the opening of the heating chamber;

a door key slidably or rotatably installed at the door, the door key including at least one hook and being biased to a predetermined direction within its operation region;

a plurality of switches operated by said at least one hook of the door key in response to opening and closing of the door;

a switch attachment member for fixedly mounting the switches, the switch attachment member including at least one hole in which said at least one hook is latched when the door is closed; and a switch operating member rotatably installed at the switch attachment member, wherein a portion of the switch operating member is located close to the hole to cover at least one switch from outside, wherein the switch attachment member includes a stopper for regulating the rotation of the switch operating member to prevent the switch operating member from approaching the hole closer than a predetermined distance, and wherein the stopper includes a resilient member for elastically preventing the switch operating member from approaching the hole closer than a predetermined distance.

2. The high frequency heating apparatus of claim 1, wherein the stopper is formed as a single body with the switch attachment member.

3. The high frequency heating apparatus of claim 2, further comprising a door release lever for opening and closing at least one of the switches as well as for opening the door, wherein the door release lever includes a free end of releasing said at least one hook from the switch attachment member by pushing said at least one hook, the free end being prevented from making a contact with the door operating member even if the free end moves up to at its maximum upward movable distance.

4. The high frequency heating apparatus of claim 1, wherein the resilient member is formed as single body with the switch attachment member.

5. The high frequency heating apparatus of claim 4, further comprising a door release lever for opening and closing at least one of the switches as well as for opening the door, wherein the door release lever includes a free end of releasing said at least one hook from the switch attachment member by pushing said at least one hook, the free end being prevented from making a contact with the door operating member even if the free end moves up to at its maximum upward movable distance.

6. The high frequency heating apparatus of claim 4, wherein the switch attachment member includes two or more mounting bases for mounting said at least one switch.

7. The high frequency heating apparatus of claim 1, further comprising a door release lever for opening and closing at least one of the switches as well as for opening the door, wherein the door release lever includes a free end of releasing said at least one hook from the switch attachment member by pushing said at least one hook, the free end being prevented from making a contact with the door operating member even if the free end moves up to at its maximum upward movable distance.

8. A high frequency heating apparatus, comprising:

a heating chamber having an opening, for loading therein an object to be heated;

a door coupled to the heating chamber, for opening and closing the opening of the heating chamber;

a door key slidably or rotatably installed at the door, the door key including at least one hook and being biased to a predetermined direction within its operation region;

a plurality of switches operated by said at least one hook of the door key in response to opening and closing of the door;

a switch attachment member for fixedly mounting the switches, the switch attachment member including at least one hole in which said at least one hook is latched when the door is closed;

a switch operating member rotatably installed at the switch attachment member, wherein a portion of the switch operating member is located close to the hole to cover at least one switch from outside; and a door release lever for opening and closing at least one of the switches as well as for opening the door, wherein the door release lever includes a free end of releasing said at least one hook from the switch attachment member by pushing said at least one hook, the free end being prevented from making a contact with the door operating member even if the free end moves up to at its maximum upward movable distance.

9. A high frequency heating apparatus, comprising:

a heating chamber having an opening, for loading therein an object to be heated;

a door coupled to the heating chamber, for opening and closing the opening of the heating chamber;

a door key slidably or rotatably installed at the door, the door key including at least one hook and being biased to a predetermined direction within its operation region;

a plurality of switches operated by said at least one hook of the door key in response to opening and closing of the door;

a switch attachment member for fixedly mounting the switches, the switch attachment member including at least one hole in which said at least one hook is latched when the door is closed;

a switch operating member rotatably installed at the switch attachment member, wherein a portion of the switch operating member is located close to the hole to cover at least one switch from outside, and wherein the switch attachment member includes a stopper for regulating the rotation of the switch operating member to prevent the switch operating member from approaching the hole closer than a predetermined distance; and a door release lever for opening and closing at least one of the switches as well as for opening the door, wherein the door release lever includes a free end of releasing said at least one hook from the switch attachment member by pushing said at least one hook, the free end being prevented from making a contact with the door operating member even if the free end moves up to at its maximum upward movable distance.

* * * * *